US012798864B2

(12) United States Patent
Sprau et al.

(10) Patent No.: US 12,798,864 B2
(45) Date of Patent: Nov. 17, 2026

(54) CANDY DISPENSER

(71) Applicant: Creata (USA) Inc., Oak Brook Terrace, IL (US)

(72) Inventors: Joyce M. Sprau, Batavia, IL (US); Mark A. Baltes, Aurora, IL (US)

(73) Assignee: Creata (USA) Inc., Oak Brook Terrace, IL (US)

( * ) Notice: Subject to any disclaimer, the term of this patent is extended or adjusted under 35 U.S.C. 154(b) by 148 days.

(21) Appl. No.: 18/670,540

(22) Filed: May 21, 2024

(65) Prior Publication Data

US 2024/0391679 A1 Nov. 28, 2024

Related U.S. Application Data

(60) Provisional application No. 63/468,090, filed on May 22, 2023.

(51) Int. Cl.
*B65D 83/04* (2006.01)
*B65D 85/60* (2006.01)

(52) U.S. Cl.
CPC ..... *B65D 83/0409* (2013.01); *B65D 85/60* (2013.01); *B65D 2583/0481* (2013.01)

(58) Field of Classification Search
CPC ..... B65D 83/049; B65D 85/60; B65D 2583/0481
See application file for complete search history.

(56) References Cited

U.S. PATENT DOCUMENTS 2,527,749 A * 10/1950 Lundeen ..... G01F 11/282 141/378
2,627,973 A * 2/1953 Sines ..... B65D 83/0409 221/277
3,132,772 A * 5/1964 Bristow ..... B05C 17/0146 222/391
3,968,902 A * 7/1976 Bachmann ..... B65D 83/0409 206/537
5,408,994 A * 4/1995 Wass ..... A61M 15/0091 128/200.14
6,401,970 B1 * 6/2002 Harris ..... A63H 1/16 221/24
2005/0269366 A1 * 12/2005 Brundick ..... B65B 37/04 222/185.1

(Continued)

*Primary Examiner* — Gene O Crawford
*Assistant Examiner* — Kelvin L Randall, Jr.
(74) *Attorney, Agent, or Firm* — Christopher J. Scott

(57) ABSTRACT

A candy dispenser enables a user to store and dispense candies therefrom. The candy dispenser includes a housing, a lever element, and a bucket element. The housing includes a candy-housing compartment, laterally opposed housing portions, an upper housing portion, and a lower housing portion. The lever element is displaceable relative to the upper housing portion and the lower housing portion. The bucket element is positioned adjacent the lower housing portion and coupled to the lever element. The bucket element is pivotal about a first pivot axis of rotation when the lever element is displaced. The candy-housing compartment receives and stores at least a candy therewithin deliverable thereto via the upper housing portion. The lever element is displaceable toward the lower housing portion for pivoting the bucket element about the first pivot axis of rotation for selectively dispensing the candy from the bucket element via the lower housing portion.

20 Claims, 16 Drawing Sheets

(56) References Cited

U.S. PATENT DOCUMENTS

| | | | | |
|---|---|---|---|---|
| 2006/0231566 | A1* | 10/2006 | Indig | G07F 11/44 221/266 |
| 2014/0175110 | A1* | 6/2014 | Bechyne | A47K 10/421 221/45 |
| 2024/0124213 | A1* | 4/2024 | Solanki | B65D 83/0409 |

* cited by examiner

CANDY DISPENSER

PRIOR HISTORY

This application claims the benefit of U.S. Provisional Patent Application No. 63/468,090 filed in the United States Patent and Trademark Office on 22 May 2023, the specifications and drawings of which are hereby incorporated by reference thereto.

FIELD OF THE INVENTION

The presently disclosed subject matter generally relates to a dispenser apparatus, and more particularly to a candy dispenser configured to receive, temporarily store, and dispense candies of multiple sizes and shapes.

GENERAL DESCRIPTION

A candy dispenser enables a user to load candies, temporarily store candies, and selectively dispense candies from the unit. In some embodiments, the candy dispenser is portable and handheld and the candies that may be dispensed therefrom may be of differing sizes and shapes. The portable handheld candy dispenser comprises a housing configured to fit within a user's hand. The housing comprises an anterior side, a posterior side, laterally opposed sides, an upper housing end or portion, and a lower housing end or portion. In some embodiments, the anterior side is configured to ergonomically engage a user's fingers and the posterior side is configured to engage a user's thumb prominence.

The upper housing end comprises a candy inlet outfitted with a removable cap element in some embodiments. In some embodiments, internal threads of the cap element are configured to screw onto threaded outer surfacing at the upper housing end adjacent the candy inlet. The lower housing end of the housing comprises a candy outlet. Relatively small or bite-size candies as variously sized and shaped are insertable into the housing via the candy inlet and selectively dispensed via the candy outlet at the lower housing end.

The user may selectively dispense candies by thumb-depressing a spring-biased button element positioned upwardly adjacent the user's thumb in some embodiments. The spring-biased button element extends upwardly from the housing at the posterior side by way of a button-positioning portion of the housing formed at the posterior side in some embodiments. The spring-biased button element comprises a button shaft or post and a spring mechanism extending within the button-positioning portion through a shaft or post-receiving aperture formed in the housing.

In some embodiments, the spring-biased button and an associated lever mechanism in line therewith is in structural communication with a candy-mixing or candy-agitating agitator mechanism and a bucket element. By depressing the spring-biased button via a user's thumb or other digit, the candy-mixing agitator mechanism is configured to rotate about an auger axis of rotation extending through an auger shaft in some embodiments. In other embodiments, the agitator mechanism comprises an array of bulbous formations extending through a column of candies within a candy-housing compartment of the candy dispenser for agitating the same for aiding migration of the candies toward the bucket element. The radially extending bulbous formations formed on the agitator shaft extend through a candy-holding space in anterior adjacency to the button-positioning portion within the housing in some embodiments.

In other words, candies received in the candy-holding space or candy-housing compartment are agitated by the radially extending arms or bulbous formations during action of button depression thereby directing candies into the candy-receiving bucket element. The candy-receiving bucket element pivots about a bucket pivot axis of rotation from a relaxed, candy-receiving position to an actuated candy-letting position at which candy-letting position candies are outlet or dispensed via the candy outlet for sharing or consumption.

In some embodiments, the resilient return action at the spring-biased button returns the candy-receiving bucket element to the relaxed, candy-receiving position to receive a successive bucket load of candies for subsequent candy dispensing. The spring-biased button element may be repeatedly depressed and returned in this manner to dispense all candies from the candy-holding space or candy-housing compartment at which time the portable handheld candy dispenser may be re-filled with candies to repeat the cycle of candy dispensing. In some embodiments, a loop feature or element is optionally formed at the upper end at the anterior side to allow a user to attach a key ring or carabiner.

There is provided in accordance with an embodiment according to the presently disclosed subject matter a candy dispenser for enabling a user to temporarily store and selectively dispense candies therefrom. The candy dispenser according to the presently disclosed subject matter may be said to essentially comprise a housing, a lever element, and a bucket element. The housing comprises a candy-housing compartment, laterally opposed housing sides, an upper housing portion, and a lower housing portion in some embodiments. In some embodiments, at least a portion of the housing is formed from a translucent material for enabling a user to see objects within the housing.

In some embodiments, the lever element is displaceable relative to the upper housing portion and the lower housing portion. In some embodiments, the bucket element is positioned adjacent the lower housing portion and operably coupled to the lever element. In some embodiments, at least a portion of the bucket element is pivotal about a first pivot axis of rotation when the lever element is displaced. The candy-housing compartment receives and stores at least one candy therewithin deliverable thereto via the upper housing portion. In some embodiments a plurality of candies forms a candy column within the candy-housing compartment. The lever element is displaceable toward the lower housing portion for pivoting the bucket element about the first pivot axis of rotation for selectively dispensing the candy from the bucket element via the lower housing portion.

In some embodiments, the housing comprises at least a first housing compartment and a second housing compartment. In some embodiments, the first housing compartment defines the candy-housing compartment and is separated from the second housing compartment by an internal housing wall. In some embodiments, the first housing compartment comprises an internal housing ramp at a lower portion thereof. In some embodiments, the internal housing ramp is obliquely angled relative to a longitudinal compartment axis of the first housing compartment for guiding the candy into the bucket element.

In some embodiments, the lever element comprises an external button element. In some embodiments, the external button element may be depressed by a user for displacing the lever element toward the lower housing portion. In some embodiments, a compression spring is in communication with the external button element. In some embodiments, the compression spring returns the external button element to a relaxed button position after the user releases the external button element. In some embodiments, the second housing compartment comprises an upper housing compartment and a lower housing compartment separated by an internal spring support wall.

In some embodiments, the internal spring support wall supports the compression spring in communication with the external button element for returning the compression spring to a relaxed configuration from an actuated configuration. In some embodiments, the external button element comprises an upper button surface. In some embodiments, the upper button surface is obliquely angled relative to the internal spring support wall. In some embodiments, the housing further comprises a button lock element. In some embodiments, the button lock element is configured to prevent downward displacement of the lever element depending on the angle of directed force thereagainst.

In some embodiments, the candy dispenser may further comprise a removable cap element. In some embodiments, the upper housing portion comprises a candy-receiving opening for receiving the candy and the removable cap element caps the candy-receiving opening. In some embodiments, the cap element may be threadably attached to the upper housing portion and in some embodiments, the cap element may be configured to snap fit upon the upper housing portion. In some embodiments, the cap element may further comprise external surfacing configured to at least enhance the visual appeal of or customize the candy dispenser as for example with a brand or logo insignia.

In some embodiments, the lower housing portion comprises a candy outlet in inferior adjacency to the bucket element. In some embodiments, the candy outlet is configured to dispense the candy therethrough when the lever element is displaced toward the lower housing portion. In some embodiments, at least a portion of the bucket element is receivable through the candy outlet when the lever element is displaced toward the lower housing portion. In some embodiments, the bucket element comprises a bottom bucket portion. In some embodiments, the bottom bucket portion is obliquely angled relative to the candy outlet for guiding the candy from the bucket element when in a fully pivoted state. In some embodiments, the bottom bucket portion is obliquely angled to receive candies from the internal housing ramp when in a relaxed, candy-receiving configuration and obliquely angled in a direction opposite the internal housing ramp when pivoted into an actuated, candy-letting configuration.

In some embodiments, the housing is configured to be ergonomically held by a user's hand and comprises an anterior housing exterior surface and a posterior housing exterior surface. In some embodiments, the anterior housing surface comprises an array of ridge and trough formations for ergonomically receiving an array of user fingers as cupped thereat. In some embodiments, the posterior housing surface is configured to abut a user's thumb prominence such that a user's opposable thumb may depress the external button element while the array of user fingers, as cupped at the anterior housing surface, direct the housing toward the thumb prominence thereby enabling the candy dispenser to be firmly secured within the user's hand.

In some embodiments, the bucket element comprises laterally opposed bucket pin elements. In some embodiments, the laterally opposed bucket pin elements extend laterally from the bucket element along the first pivot axis of rotation and are rotatably held at the laterally opposed housing portions. In some embodiments, the bucket element may further comprise laterally opposed coupler elements and the lever element may further comprise a lower lever end. In some embodiments, the lower lever end may further comprise laterally opposed lever pin elements. In some embodiments, the laterally opposed lever pin elements are pivotally held by the laterally opposed coupler elements for defining at least a second pivot axis of rotation extending through the laterally opposed lever pin elements.

In some embodiments, the candy dispenser may further comprise an agitator element. In some embodiments, the agitator element is coupled to the lever element and is simultaneously displaceable when the lever element is displaced for agitating the candy for aiding migration of the candy toward the bucket element. In some embodiments, the agitator element extends through at least one internal housing aperture, which internal housing aperture(s) are configured to guide the agitator element when the lever element is displaced. In some embodiments, the agitator element comprises a ridged or serially bulbous exterior surface configured for enhancing agitation of the candy when the lever element is displaced.

BRIEF DESCRIPTION OF THE DRAWINGS

Other features and objectives of the presently disclosed subject matter will become more evident from a consideration of the following brief descriptions of patent drawings.

DETAILED DESCRIPTION OF THE EMBODIMENTS

Figure 1:
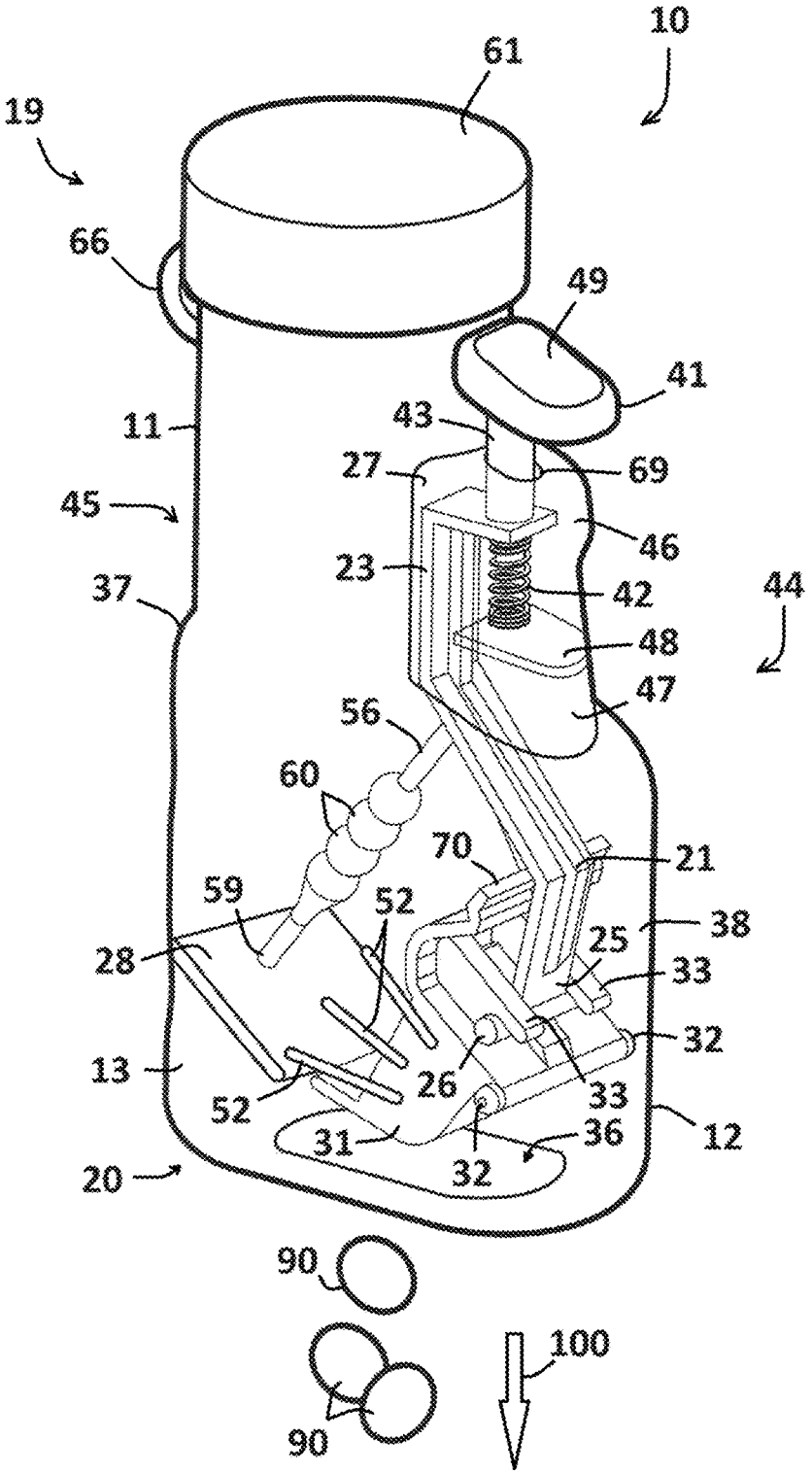
FIG. 1 is a first posterior top perspective view of the candy dispenser according to the presently disclosed subject matter depicting uniformly sized and shaped candies being dispensed therefrom and depicting a translucent housing for enabling a user to visually see internal components.

Referring now to the drawings with more specificity, the presently disclosed subject matter concerns a candy dispenser as generally depicted and referenced at 10. The candy dispenser 10 according to the presently disclosed subject matter very basically enables a user to load candies 90 into the candy dispenser 10 as generally depicted in FIG. 3B at down arrow 108, temporarily store the candies 90 as loaded into the candy dispenser 10 for portability thereof as generally depicted in FIG. 3C, and selectively dispense candies 90 from the candy dispenser 10 for sharing or consumption as generally depicted in FIGS. 1, 1A, 2, and 10B.

Referencing FIGS. 1, 1A, 2, and 10B, the reader will there consider candies 90 being dispensed from the candy dispenser 10 as at down arrow 100. In some embodiments, the candy dispenser 10 is configured to be comfortably held by a user's hand 200 and thereby made portable. Accordingly, in some embodiments the candy dispenser 10 is portable and handheld. While the candy dispenser 10 has been illustrated as being portable and handheld, the illustrations submitted in support of these specifications, and as particularly presented in FIG. 2, should not be construed as limiting as other larger and/or fixed, non-portable versions are contemplated.

Figure 1A:
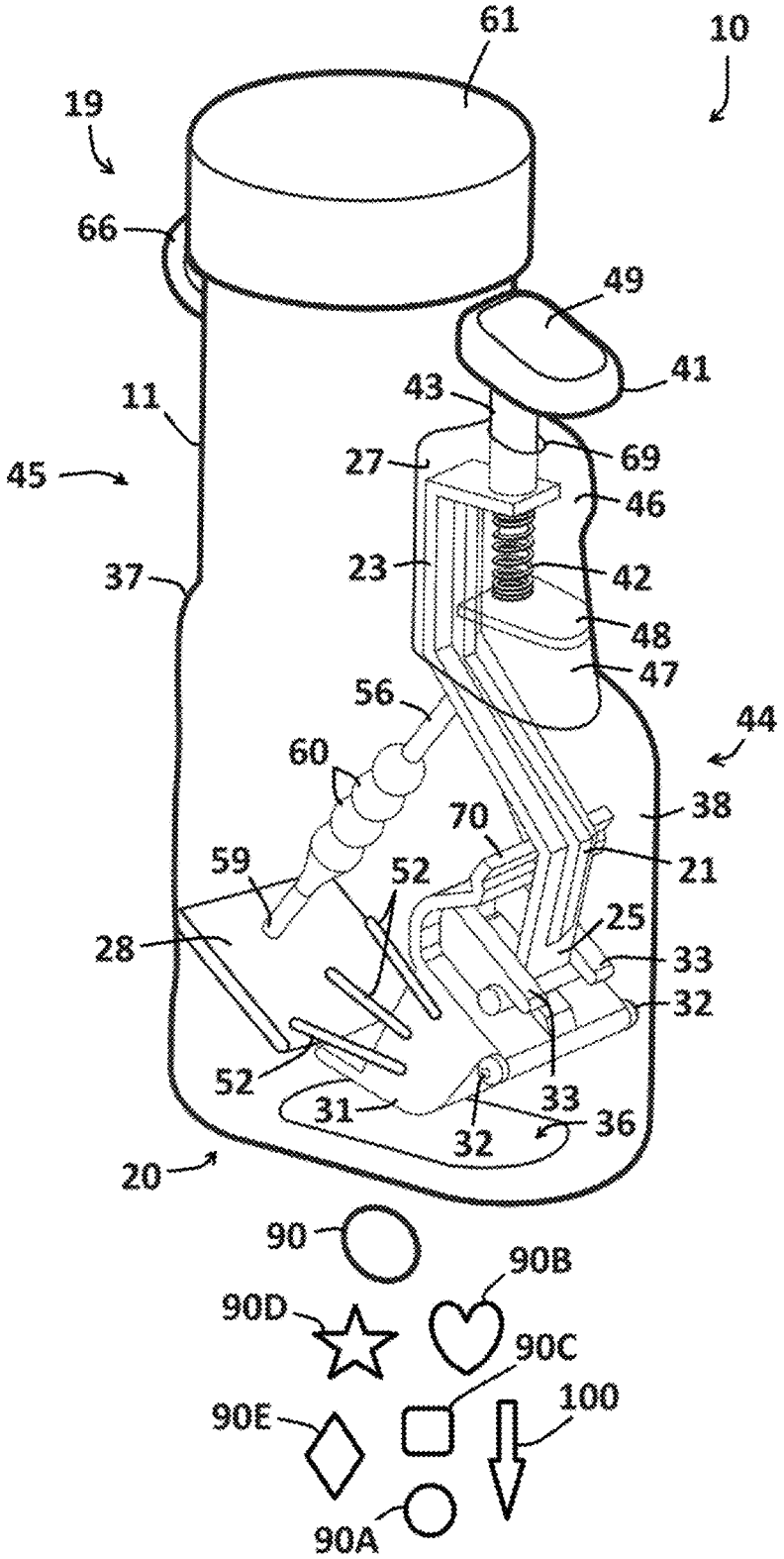
FIG. 1A is a second posterior top perspective view of the candy dispenser according to the presently disclosed subject matter depicting variously sized and shaped candies being dispensed therefrom and depicting a translucent housing for enabling a user to visually see internal components.
Figure 2:
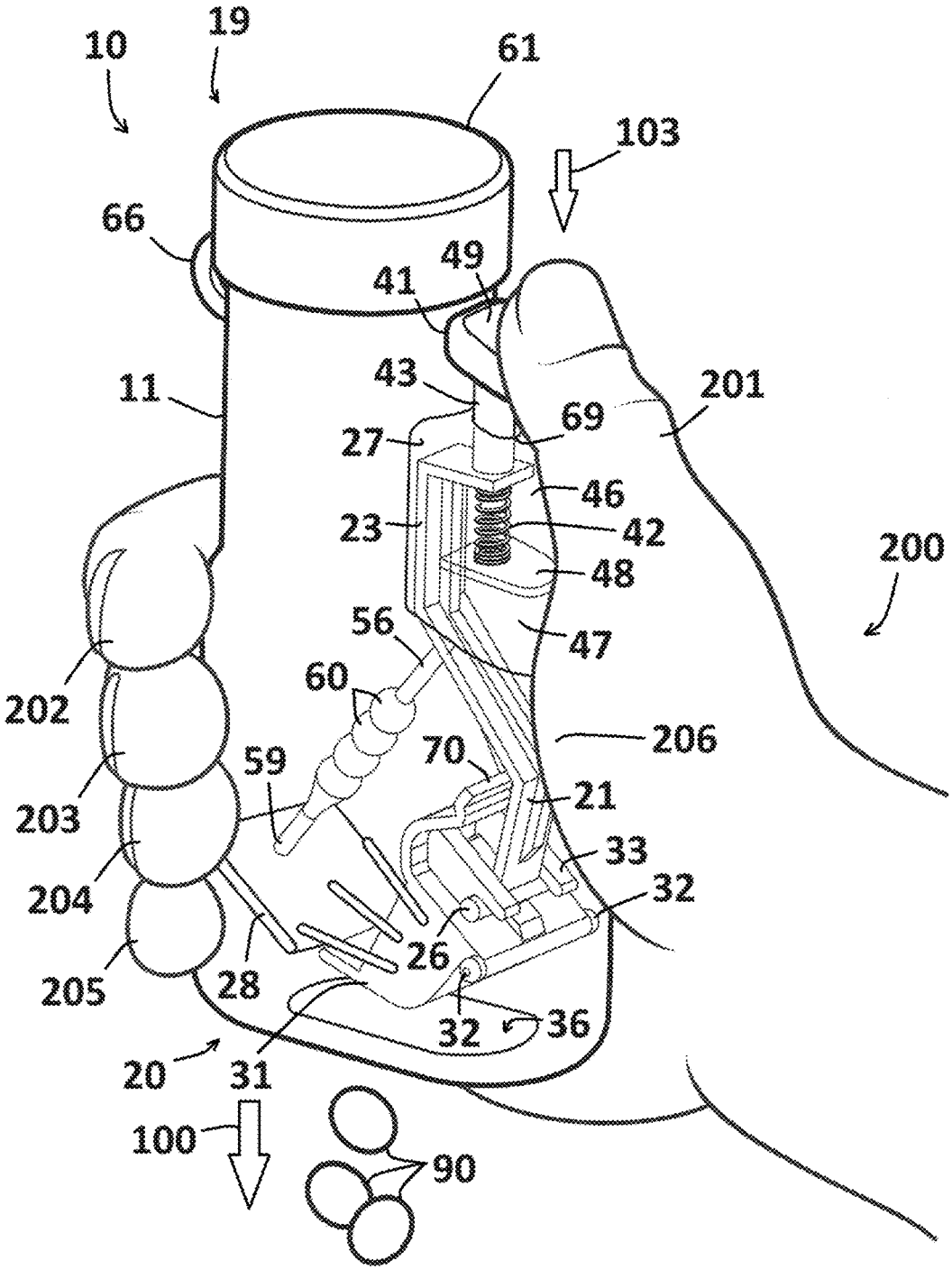
FIG. 2 is a posterior top perspective view of the candy dispenser according to the presently disclosed subject matter depicting a user holding the candy dispenser and depressing an external button element for dispensing uniformly sized and shaped candies therefrom and depicting a translucent housing for enabling a user to visually see internal components.
Figure 3A:
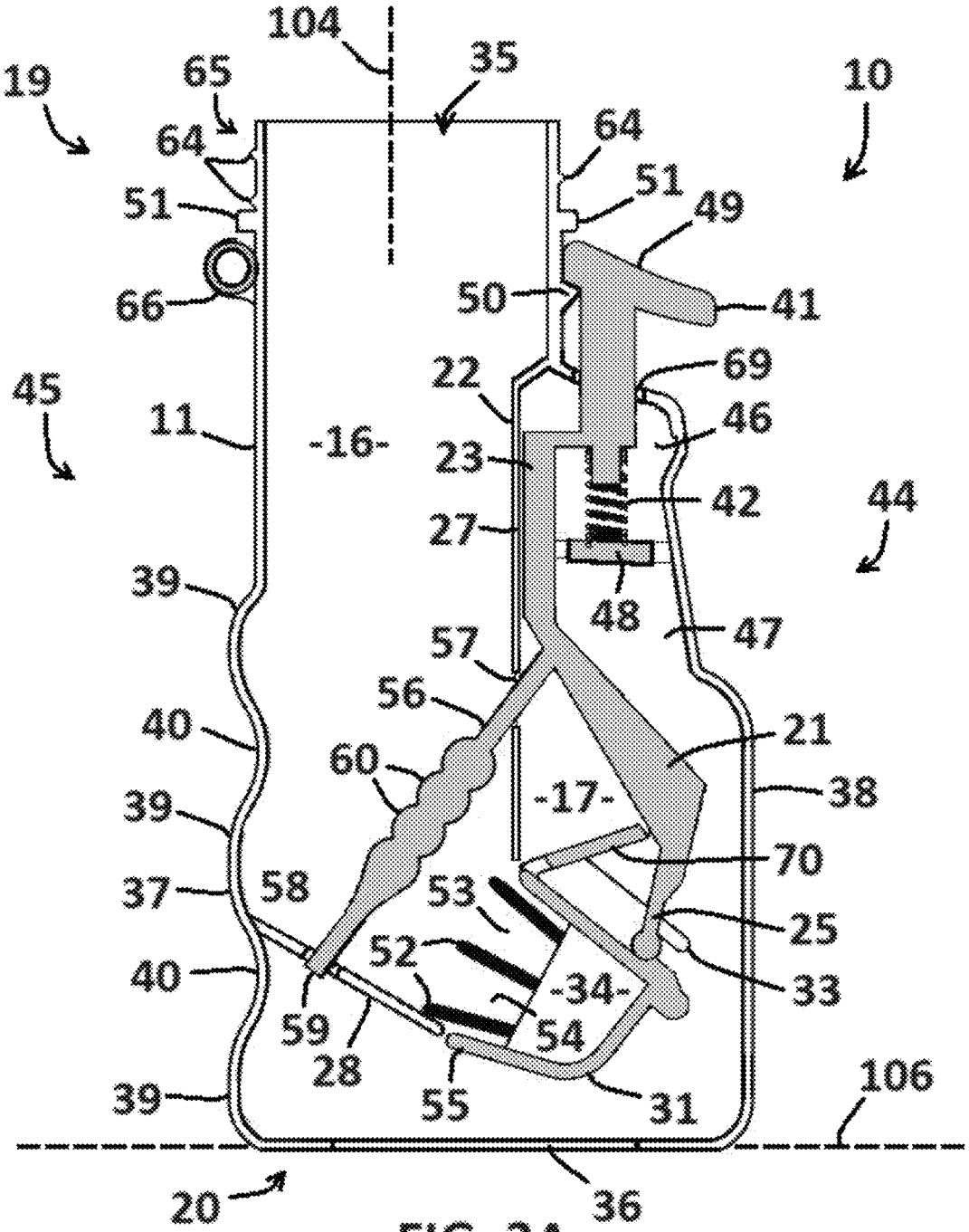
FIG. 3A is a first sequential longitudinal cross-sectional view of the candy dispenser according to the presently disclosed subject matter with a cap element removed before candies are loaded therein.
Figure 3B:
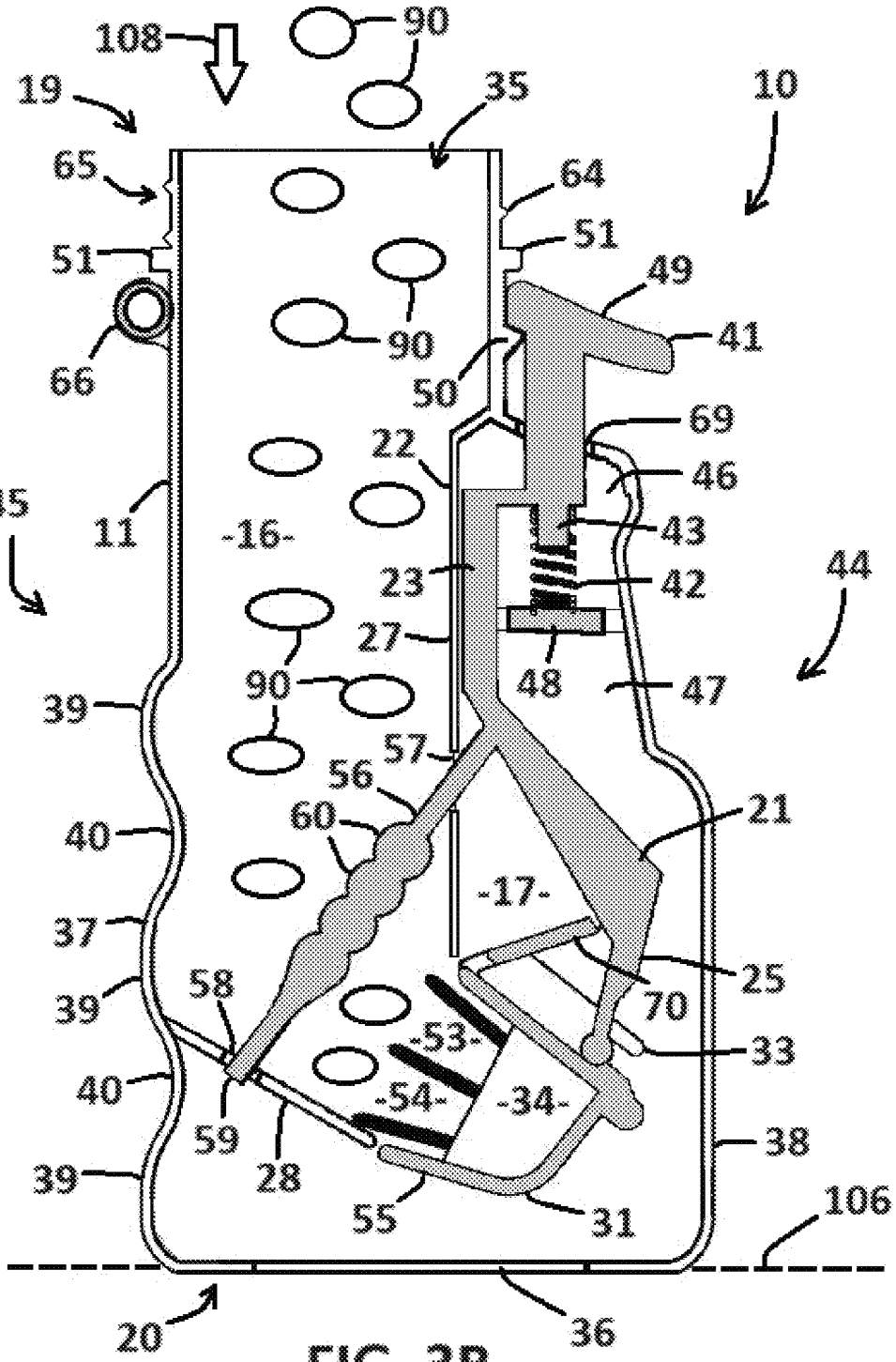
FIG. 3B is a second sequential longitudinal cross-sectional view of the candy dispenser according to the presently disclosed subject matter with the cap element removed and depicting candies being loaded therein.
Figure 3C:
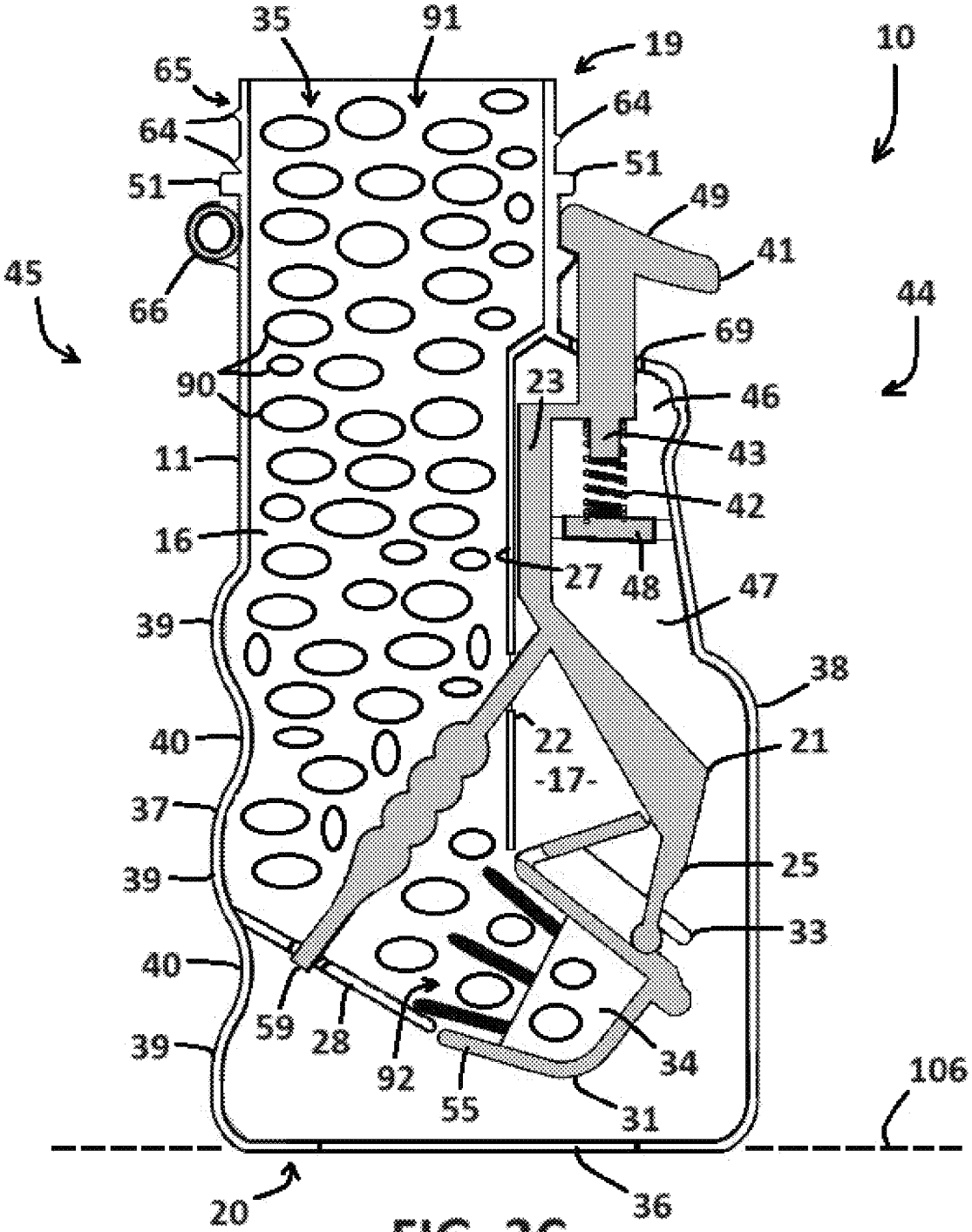
FIG. 3C is a third sequential longitudinal cross-sectional view of the candy dispenser according to the presently disclosed subject matter with the cap element removed and depicting a fully loaded candy dispenser with a candy column of candies loaded therein.
Figure 3D:
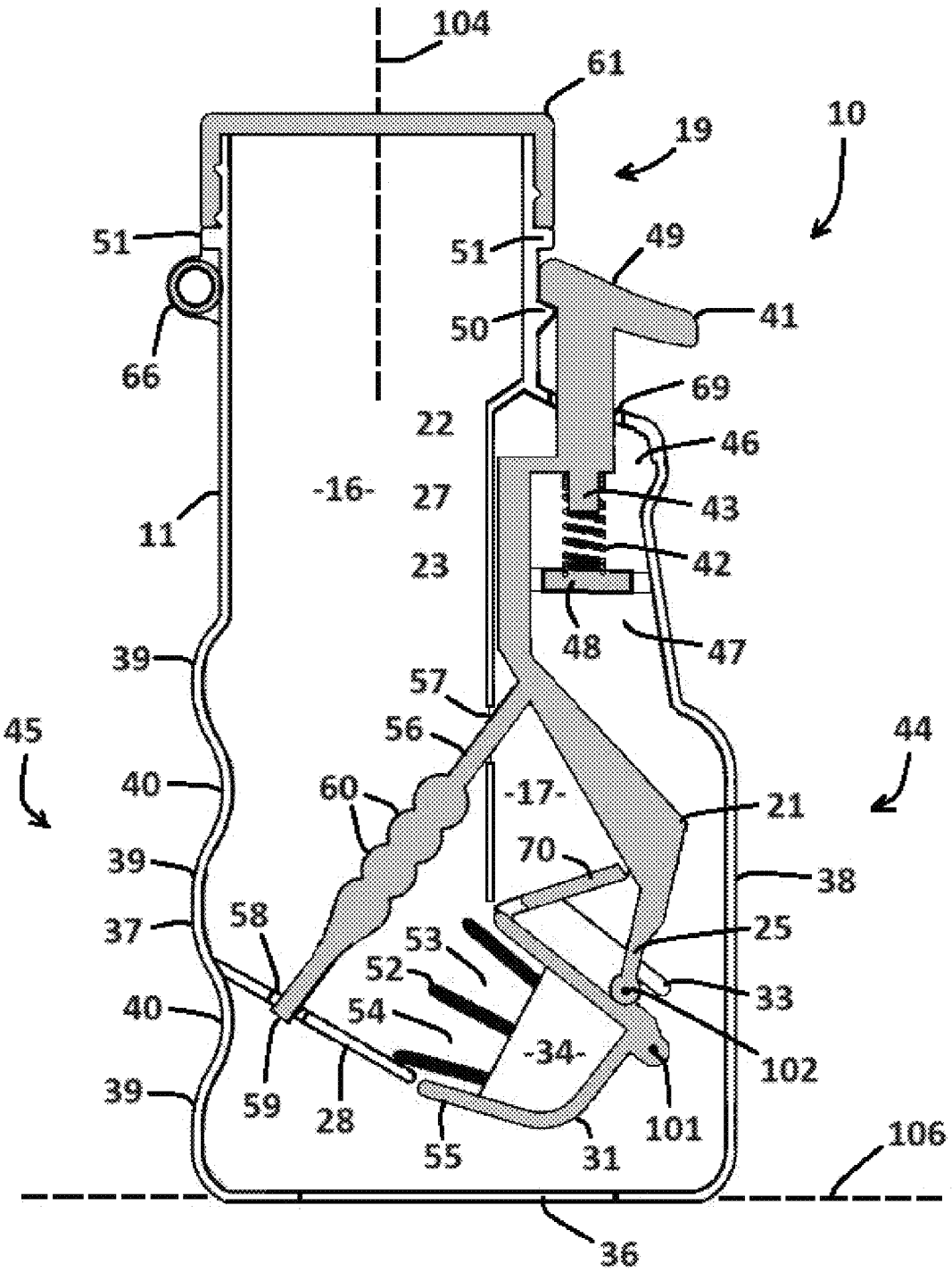
FIG. 3D is a longitudinal cross-sectional view of an empty candy dispenser according to the presently disclosed subject matter with the cap element installed.
Figure 4:
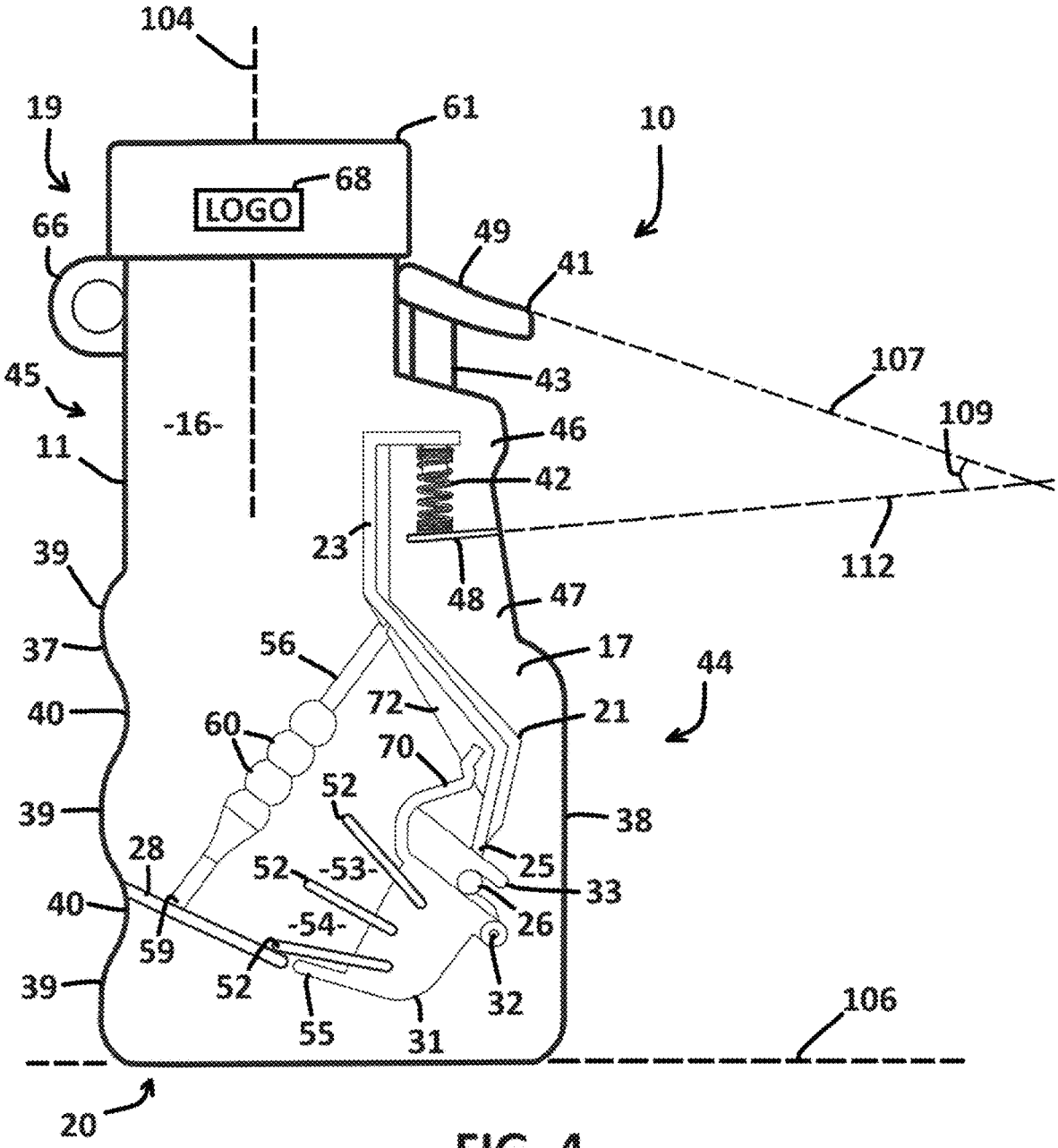
FIG. 4 is an elevational lateral side view of an empty candy dispenser according to the presently disclosed subject matter with the cap element installed and depicting a translucent housing for enabling a user to visually see internal components.
Figure 5:
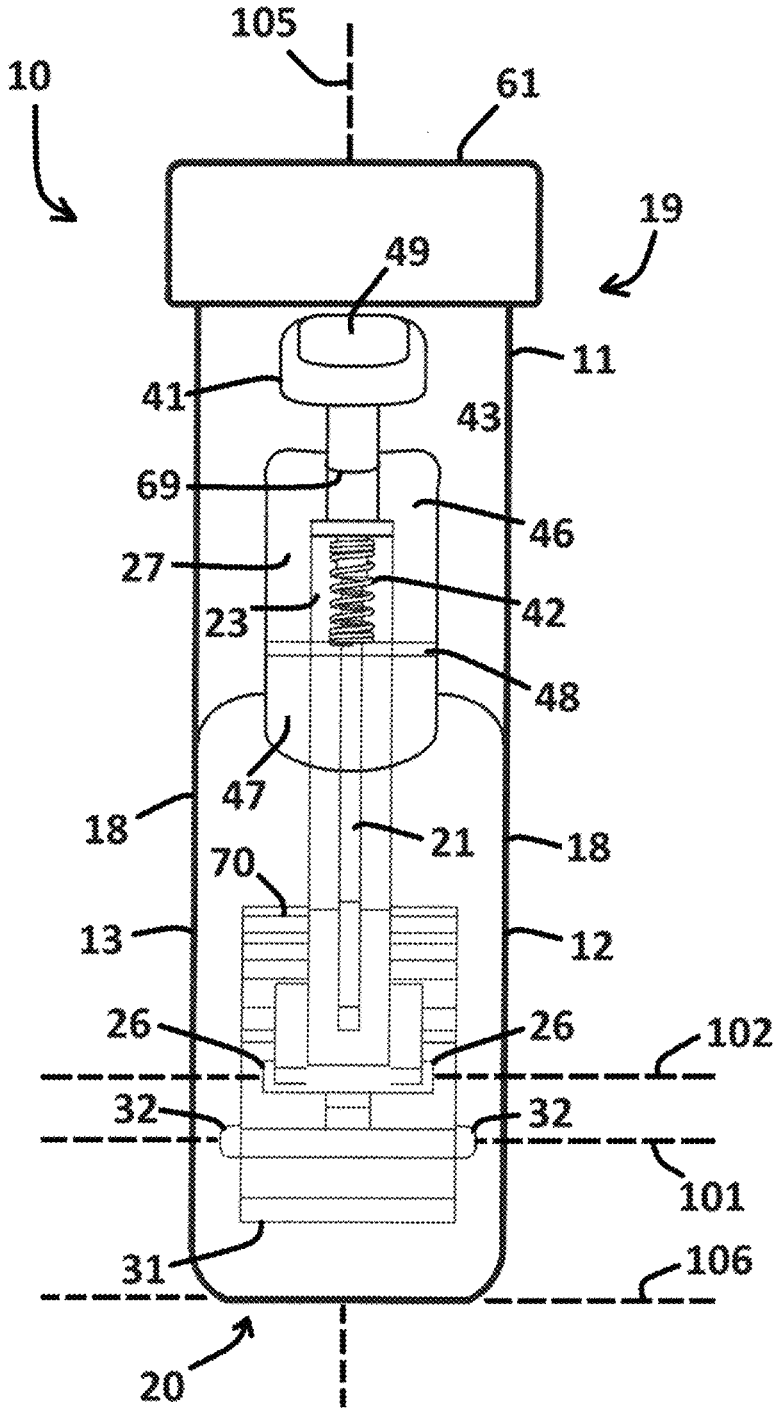
FIG. 5 is an elevational posterior view of an empty candy dispenser according to the presently disclosed subject matter with the cap element installed and depicting a translucent housing for enabling a user to visually see internal components.

In some applications, the candies 90 loadable into and dispensable from the candy dispenser 10 may be of uniform size and shape as generally depicted in FIGS. 1 and 2. In other applications, the candies 90 may be of differing sizes and shapes as generally and comparatively depicted in FIG. 1A. While a common application for the candy dispenser 10 is to dispense bite-size, lentil-shaped candies 90, other shapes and sizes of candies 90 are contemplated. For example, other shapes of the candies 90 may include, but not be limited to (jelly) bean-shaped candies, sphere-shaped or ball-shaped candies as at 90A, fruit-shaped candies, letter-shaped candies, and button-shaped candies, heart-shaped candies as at 90B as depicted in FIG. 1A.

Other contemplated shapes include animal-shaped candies, coin-shaped candies, square-shaped candies as at 90C, star-shaped candies as at 90D, diamond-shaped candies as at 90E, and any number of other fanciful-shaped candies as further embraced by FIG. 2. While the candies 90 have been variously illustrated and referenced at 90 (and 90A through 90E), these should not be construed as limiting. This being said, the candies 90 usable in combination with the candy dispenser 10 should be of a sufficient size so as to be insertable into the candy dispenser 10 at a top portion thereof with a plurality of candies fitting within certain candy-containing compartments of the candy dispenser 10, and dispensable as at down arrow 100 through a bottom portion thereof.

Figure 7:
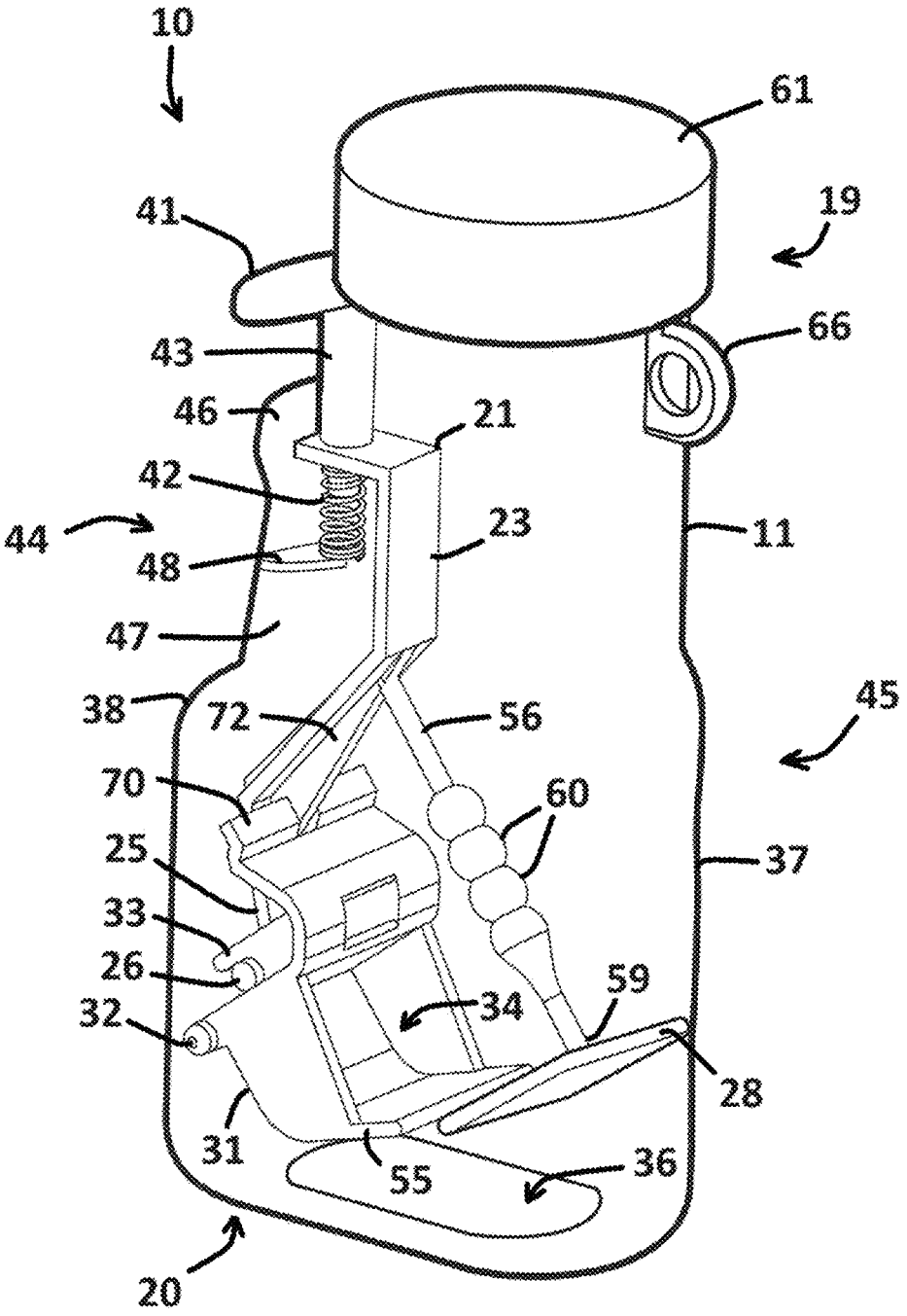
FIG. 7 is an anterior top perspective view of the candy dispenser according to the presently disclosed subject matter depicting a translucent housing for enabling a user to visually see internal components.

The candy dispenser 10 according to the presently disclosed subject matter may be said to essentially comprise a housing as at 11, a lever element as at 21, and a bucket element as at 31 each of which are described in turn in more detail hereinafter. At the outset, however, it should be noted that at least a portion of the lever element 21 and the entirety of the bucket element 31 are housed within the housing 11 in some embodiments. In some embodiments, the housing 11 comprises a right housing portion as at 12 and a left housing portion as at 13 as particularly referenced in FIG. 7. The right housing portion 12 and the left housing portion 13 are affixed to one another along a housing seam 14 extending along a longitudinal housing plane 105.

Figure 6:
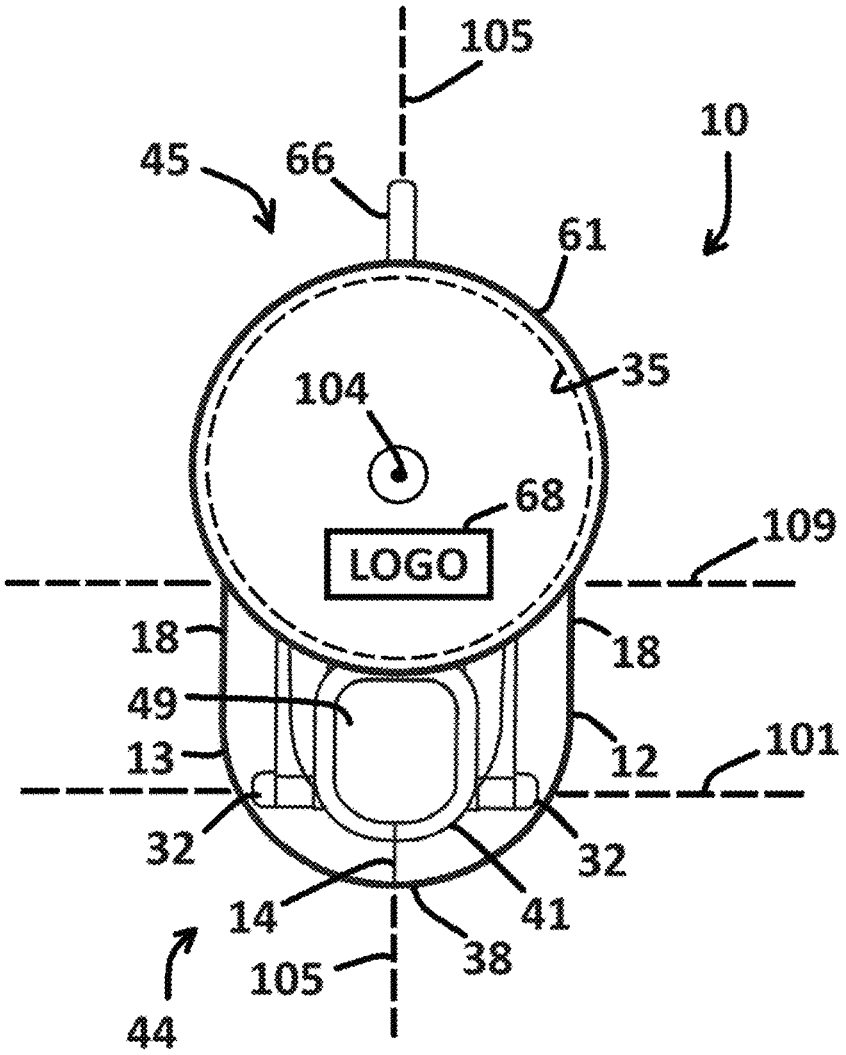
FIG. 6 is a top view of an empty candy dispenser according to the presently disclosed subject matter with the cap element installed and depicting a translucent housing for enabling a user to visually see internal components.

In some embodiments, the right housing portion 12 and the left housing portion 13 are symmetrical about the longitudinal housing plane 105 as generally depicted in FIG. 6. An inner housing-opposing surface 15 of the right housing portion 12 is further referenced in FIG. 7. The inner housing-opposing surface 15 of the right housing portion 12 is affixed to an analogous inner housing-opposing surface of the left housing portion 13 along the longitudinal housing plane 105 at the housing seam 14. In some embodiments, it is contemplated the housing 11 may be ergonomically formed to be hand specifical. That is, in some embodiments the housing 11 may be formed so as to more ergonomically fit into either a user's left hand or a user's right hand. While the housing 11 has been illustrated as being generally symmetric about the longitudinal housing plane 105, this should not be construed as limiting.

In some embodiments, the right housing portion 12 and the left housing portion 13 may be formed from moldable materials so as to ease mass-produced production thereof at minimized cost. In some embodiments, the right housing portion 12 and the left housing portion 13 may be formed from opaque materials for preventing a user to see through the housing 11, and in some embodiments, the right housing portion 12 and the left housing portion 13 may be formed from translucent or transparent materials for enabling a user to visually perceive inner components and candies 90 as stored therewithin.

In some embodiments, either the right housing portion 12 or the left housing portion 13 may further comprise one or more first matable structures as exemplified by a peg-receiving or post-receiving formation while the other of the right housing portion 12 and the left housing portion 13 may further comprise one or more second matable structures as exemplified by a peg or post. Together, the first and second matable structures are configured to mate the right housing portion 12 to the left housing portion 13 in some embodiments.

When the right housing portion 12 is affixed to the left housing portion 13, the resulting housing 11 further provides or comprises a first or distal housing compartment as at 16, a second or proximal housing compartment as at 17, laterally opposed housing sides as at 18, an upper housing portion 19, and a lower housing portion as at 20. In some embodiments, the first or distal housing compartment is characterized by a candy-housing compartment for holding at least one candy 90. In some embodiments, the candy-housing compartment is configured to hold a candy column 91 of candies 90.

The housing 11 may be said to further comprise an anterior or distal housing portion 45 and a posterior or proximal housing portion 44. In this regard, it will be understood the housing 11 of the candy dispenser is asymmetric about a frontal housing plane 109 such that the candy dispenser 10 does have an anterior or distal housing portion as at 45 and a posterior or proximal housing portion as at 44 for directional fit into a user's hand as at 200 in FIG. 2 in some embodiments. In other words, in some embodiments, the candy dispenser 10 comprises a front side as at 45 and a back side as at 44. The front side 45 is distally located relative to a user and the back side 44 is proximally located relative to a user.

Figure 8:
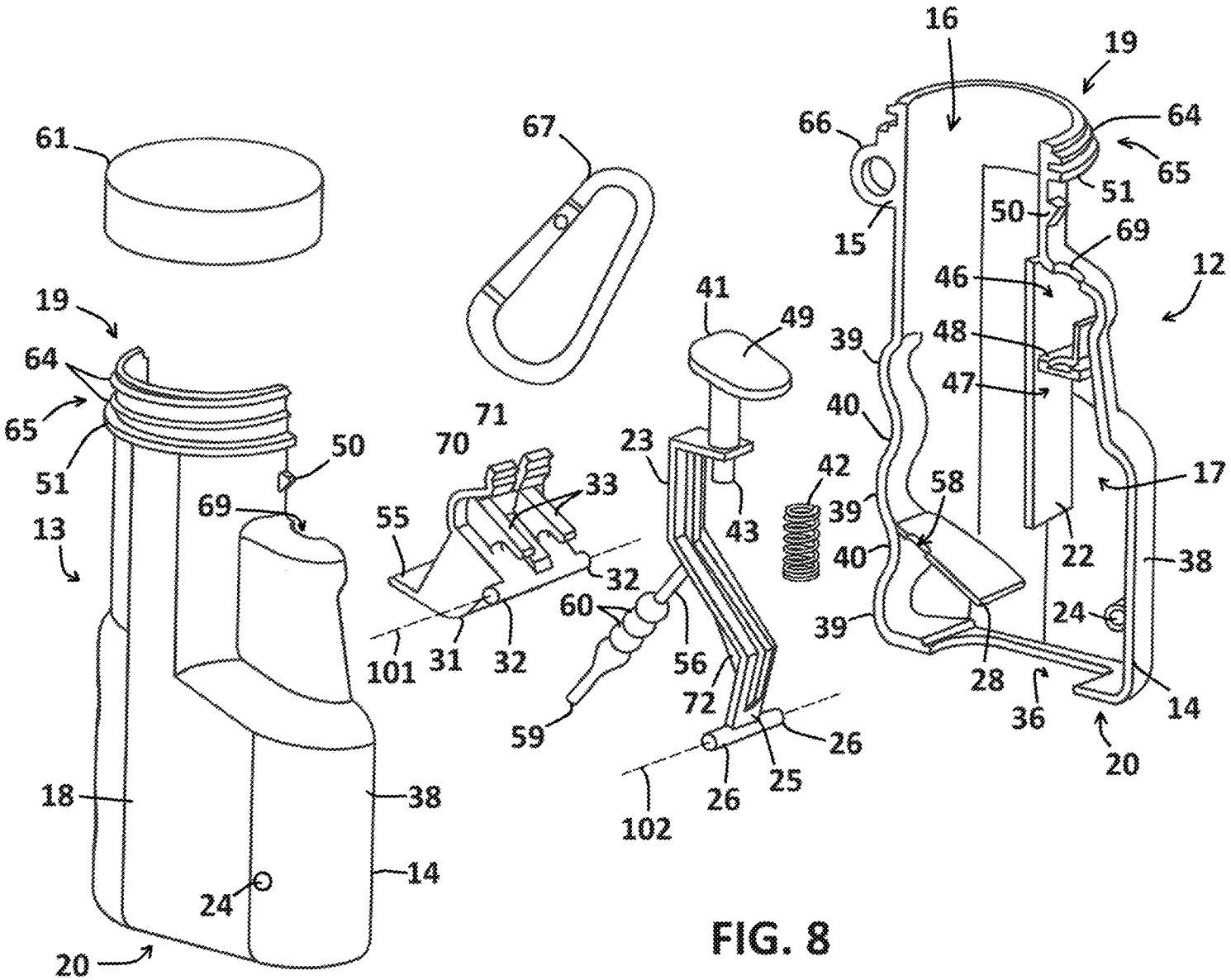
FIG. 8 is an exploded view of the candy dispenser according to the presently disclosed subject matter depicting an array of candy dispenser components, including a cap element, a left housing portion, an optional carabiner element, a bucket element, a lever element, a compression spring, and a right housing portion.

In some embodiments, at least one of the anterior housing portion or front side 45 and the posterior housing portion or back side 44 may comprise a carabiner attachment mechanism for enabling a user to attach an optional carabiner 67 or similar other ring element thereto as particularly referenced in FIG. 8. In some embodiments, the carabiner attachment mechanism may be in the form of a loop formation 66 attached to or extending from the anterior housing portion 45 at the upper housing portion 19 along the longitudinal housing plane 105 as exemplified in the drawing support submitted in support of these specifications. The carabiner attachment mechanism and carabiner 67 or similar other ring element further aid portability of the candy dispenser 10 by enabling the user to link the ensemble to environment support structures. While the carabiner attachment mechanism has been exemplified as a loop formation 67, this should not be construed as limiting.

In some embodiments, the upper housing portion 19 comprises or provides a candy-receiving opening or candy inlet 35 for receiving candies 90 as at arrow 108 in FIG. 3B, which received candies 90 are then temporarily stored within the first or distal housing compartment 16 as characterized by a candy-housing compartment. In some embodiments, the received candies 90 are temporarily stored within the first or distal housing compartment 16 as a candy column 91 as generally depicted in FIG. 3C. In some embodiments, the lower housing portion 20 comprises a candy-letting opening or candy outlet as at 36. In some embodiments, the candy outlet 36 extends along an outlet plane 106 and is configured to outlet candies 90 for dispensing a candy column bottom 92 therethrough. In other words, those candies 90 located at the bottom of the candy column 91 are dispensable through the candy outlet 36 at the lower housing portion 20 in some embodiments.

In some embodiments, the housing 11 is configured to be ergonomically held with or by a user's hand as at 200 in FIG. 2. It will be recalled that in some embodiments, the housing 11 is symmetrical about the longitudinal housing plane 105. Accordingly, in some embodiments the candy dispenser 10 is ambidextrous and may be comfortably held in either a user's left hand or a user's right hand 200, the latter of which has been generally depicted and referenced in FIG. 2. In some embodiments, the housing 11 comprises an anterior or distal housing exterior surface 37 at the anterior or distal housing portion 45 and a posterior or proximal housing exterior surface 38 at the posterior or proximal housing portion 44. In some embodiments, the anterior or distal housing surface 38 or the anterior distal housing portion 45 may comprise an array of ridge formations 39 serially separated by an array of trough formations 40 for ergonomically receiving an array or series of user fingers as cupped thereat.

Further referencing FIG. 2, for example, the reader will there see an index finger 202, a middle finger 203, a ring finger 204, and a little finger 205. The user's opposable thumb is referenced at 201. As illustrated, the user's index finger 202 may be positioned in superior adjacency to a top ridge formation 39; the user's middle finger 203 may be positioned at a top trough formation 40; the user's ring finger 204 may be positioned at a bottom trough formation 40; and the user's little finger 205 may be positioned in inferior adjacency to the user's ring finger 204 upon a bottom ridge formation 39.

In some applications, the user's little finger 205 may be positioned in inferior adjacency to the lower housing portion 20 for supporting the housing 11 of the candy dispenser 10 although not specifically illustrated. In some embodiments, the posterior or proximal housing surface 38 and the posterior or proximal housing portion 44 may be configured to abut a user's thumb prominence 206 of the user's hand 200 such that the user's opposable thumb 201 may depress an external button element 41 of the lever element 21 while the user's fingers (202 through 205), as cupped at the anterior or distal housing surface 37, may direct the housing 11 toward the thumb prominence 206 thereby enabling the housing 11 of the candy dispenser 10 to be manually and firmly secured within the user's hand 200.

In some embodiments, the external button element 41 of the lever element 21 is external to the housing 11 for enabling a user to depress the same with the user's thumb 201 as at arrow 103 in FIG. 2 while lower portions of the lever element 21 are received or housed within the housing 11. In some embodiments, the lower portions of the lever element 21 are housed or received within the second or proximal housing compartment 17. The external button element 41 and the lower portions of the lever element 21 are thereby displaceable intermediate the upper housing portion 19 and the lower housing portion 20.

In some embodiments, the first or distal housing compartment 16 is separated from the second or proximal housing compartment 17 by an internal housing wall as at 22. In some embodiments, at least a portion of the lever element 21 abuts the internal housing wall 22 within the second or proximal housing compartment 17 and is configured to be displaceable therealong. In some embodiments, the internal housing wall 22 is planar at a lever-abutting portion 27. In some embodiments, an upper lever portion 23 of the lever element 21 is substantially planar and slides along the internal housing wall 22 along a proximal side surface of the lever-abutting portion 27 within the second or proximal housing compartment 17.

It will be understood the lever element 21 may comprise an external button element 41 at the posterior or proximal housing portion 44, which external button element 41 may be depressed as at down arrow 103 by an opposable thumb 201 or other digit of a user for displacing lower portions of the lever element 21 toward the lower housing portion 20. In some embodiments, the candy dispenser 10 may further comprise a compression spring 42 in communication with or connected to the external button element 41. In some embodiments, the compression spring 42 is helical in form defining an inner female formation configured to mate with a male post element 43 extending downwardly from and coextensive with the external button element 41.

In some embodiments, the downwardly extending post element 43 extends through a post-receiving aperture 69 formed in the housing 11 at the posterior housing portion 44 into an upper posterior housing compartment 46. The compression spring 42 is essentially a resilient member for returning the external button element 41 to a relaxed button position toward the upper housing portion 19 after the user depresses as at arrow 103 the external button element 41 for displacing lower portions of the lever element 21 toward the lower housing portion 20 for pivoting the bucket element 31. In some embodiments, the upper posterior housing compartment 46 is separate and distinct from a lower posterior housing compartment 47.

In other words, the second or proximal housing compartment 17 may be said to be sub-compartmentalized having the upper posterior housing compartment 46 and the lower posterior housing compartment 47. In some embodiments, the upper posterior housing compartment 46 is separated from the lower posterior housing compartment 47 by an internal spring support wall 48. In some embodiments, the internal spring support wall 48 is configured to support the compression spring 42 in communication with the external button element 41 during depressing action 103 of the external button element 41.

When the external button element 41 is depressed as at arrow 103, lower potions of the lever element 21 are displaced downwardly toward the lower housing portion 20 to pivot the bucket element 31 at least about a first pivot axis of rotation 101. When the external button element 41 is released, the resilient action of the compression spring 42 is operable to return to the external button element 41 and the lower portions of the lever element 21 to a relaxed position as generally depicted in FIGS. 1, 1A, 3A-3D, 4, 5, and 7.

In some embodiments, the external button element 41 comprises an upper button surface 49, which upper button surface 49 may be obliquely angled relative to the internal spring support wall 48. In this regard, the reader is directed to FIG. 4. Referencing FIG. 4, the reader will there see an upper button surface plane 107 of the upper button surface 49, which upper button surface plane 107 is obliquely angled as at angle 109 relative to a support wall plane 112 of the internal spring support wall 48. In some embodiments, the posterior housing portion 44 at the external button element 41 may further comprise at least one button lock or locator element as at 50 positioned in inferior adjacency to the external button element 41 when the external button element 41 is in the relaxed configuration as further depicted in FIG. 9A. In some embodiments, the button lock element 50 selectively prevents downward displacement of the external button element 41 and lower portions of the lever element 21.

It will be recalled the upper button surface 49 of the external button element 41 may be obliquely angled relative to the internal spring support wall 48 in some embodiments. During the process of depressing 103 the external button element 41 by a user's thumb 201, force vector components may be anteriorly directed, at least in part. In other words, forces have an anteriorly directed vector component may direct the external button element 41 toward the button lock element 50 via the obliquely angled upper button surface 49. Such action prevents downward displacement of the external button element 41 in some embodiments. In some embodiments, proper depressing action of the external button element 41 comprise a posterior vector component as at arrow 111.

In some embodiments, the upper surface 73 of the button lock element 50 may be obliquely angled relative to the longitudinal compartment axis 104 for enabling the user to displace the external button element 41 posteriorly as at vector 111. In this regard, the post-receiving aperture 69 is sized and shaped or configured to enable displacement of the post element 43 in a posterior direction a sufficient degree to allow downward depressing action as at arrow 103 of the external button element 41. In other words, in some embodiments, the post-receiving aperture 69 enables a shift of the post element 43 posteriorly to enable the downward depressing action 103 of the external button element 41.

Figure 9A:
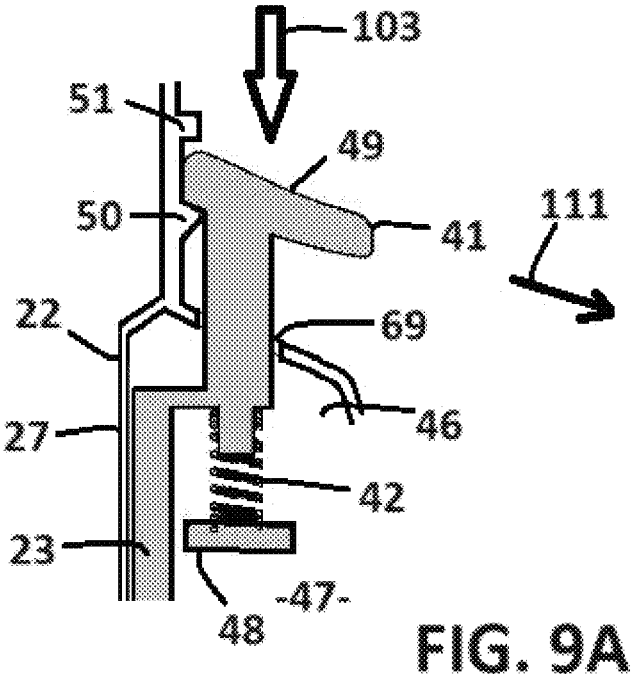
FIG. 9A is an enlarged sectional view of an external button element of the lever element juxtaposed adjacent upper posterior portions of the candy dispenser before being depressed so as to displace lower portions of the lever element.

In some embodiments, the anterior housing portion 45 and the posterior housing portion 44 may further comprise a flange-like ridge formation 51, which ridge formation 51 may operate as a secondary button locator element at the posterior housing portion 44. In some embodiments, the ridge formation 51 doubles as a cap seat around the circumference of the upper housing portion 19. When the external button element 41 is in the relaxed state or configuration as generally depicted in FIG. 9A, the external button element 41 is positioned intermediate the button lock element 50 and the ridge formation 51. In some embodiments, a removable cap element 61 may cap, cover or close the candy-receiving opening or candy inlet 35 at the upper housing portion 19. In some embodiments, the ridge formation 51 provides a cap seat or cap-limiting feature for the cap element 61 as attached to an external upper housing portion 65 of the upper housing portion 19.

The bucket element 31 is positioned within the lower housing portion 20 and in some embodiments is pivotally coupled to both lower portions of the lever element 21 and the laterally opposed housing sides 18. In this regard, the right housing portion 12 and the left housing portion 13 each comprise a pin-receiving aperture or female formation 24 at or adjacent the lower housing portion 20. The bucket element 31 comprises laterally opposed bucket pin elements 32 in some embodiments. The laterally opposed bucket pin elements 32 extend laterally from the bucket element 31 along a common first pivot axis of rotation 101 and are received in the pin-receiving apertures or formations 24 formed in the laterally opposed housing portions 18 thereby being rotatably or pivotally held.

Figure 9B:
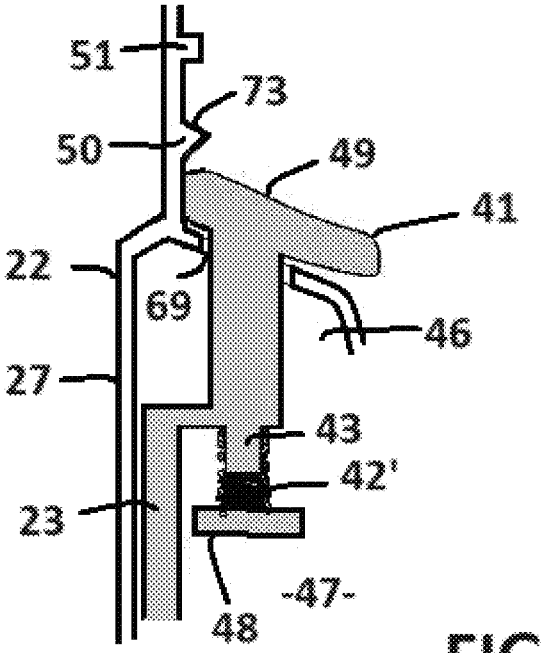
FIG. 9B is an enlarged sectional view of the external button element of the lever element juxtaposed adjacent upper posterior portions of the candy dispenser otherwise depicted in FIG. 9A after being depressed so as to displace lower portions of the lever element.

In some embodiments, the bucket element 31 further comprises laterally opposed coupler elements 33 and the lever element 21 comprises a lower lever end 25. In some embodiments, the lower lever end 25 comprises laterally opposed lever pin elements as at 26. The laterally opposed lever pin elements 26 are pivotally held by the laterally opposed coupler elements 33 for defining a common second pivot axis of rotation 102 extending through the laterally opposed lever pin elements 26. In some embodiments, the lower lever end 25 also undergoes a linear displacement or shift as comparatively depicted in FIG. 9A versus FIG. 9B. In other words, as the external button element 41 is depressed as at 103, the lower lever end 25 shifts anteriorly toward the internal housing ramp 28 for enabling fixed pivotal rotation about the first axis of rotation 101 by the bucket element 31.

As earlier described, the first or distal housing compartment 16 is configured to receive and temporarily store a plurality of candies 90 in a candy column 91. In other words, the candy column 91 comprises a plurality of candies 90 as stacked within the first or distal housing compartment 16 and are delivered thereto as at arrow 108 via the candy-receiving opening or candy inlet 35 at the upper housing portion 19. In some embodiments, the second or proximal housing compartment 17 is configured to house at least lower portions of the lever element 21. The bucket element 31 is positioned intermediate the first or distal housing compartment 16 and the second or proximal housing compartment 17 at bottom portions thereof with a candy-holding bucket portion 34 facing the first or distal housing compartment 16. The candy-holding bucket portion 34 holds a candy column bottom 92 of the candy column 91, which candy column bottom 92 comprises at least one, but preferably a plurality of candies 90 before the action of candy dispensing as at arrow 100.

In some embodiments, the right housing portion 12 and the left housing portion 13 may each further comprise an array of corresponding candy-directing shelve elements 52. The candy-directing shelve elements 52 extend inwardly from inner surfacing of the right housing portion 12 and the left housing portion 13 in lateral adjacency to the bucket element 31 for guiding candies 90 as they travel or migrate toward the candy outlet 36 thereby aiding compartmentalization of the candy column bottom 92. In some embodiments, the candy-directing shelve elements 52 are obliquely angled relative to the longitudinal compartment axis 104 and provide an upper compartment zone 53 and a lower compartment zone 54.

The candies 90 at the bottom of the candy column 91 or candy column bottom 92 are essentially directed into and positioned within the lower compartment zone 54 and the candy-holding bucket portion 34. When a plurality of candies 90 of the candy column bottom 92 are dispensed from the candy dispenser 10 via the candy outlet 36, candies 90 located within the upper compartment zone 53 shift to the candy column bottom 92 position within the lower compartment zone 54 and the candy-holding bucket portion 34 for subsequent candy dispensing action.

In some embodiments, the lever element 21 is at least downwardly displaceable by thumb-depressing the external button element 41 as at arrow 103 toward the lower housing portion 20 for pivoting the bucket element 31 about at least the first pivot axis of rotation 101 for selectively dispensing as at down arrow 100 candies 90 of the candy column bottom 92 from the first or distal housing compartment 16 via the candy outlet 36 at the lower housing portion 20. In some embodiments, the first or distal housing compartment 16 comprises an internal housing ramp 28 above the lower housing portion 20. In some embodiments, the internal housing ramp 28 is obliquely angled relative to the longitudinal compartment axis 104 for guiding candies 90 at the candy column bottom 92 into the candy-holding bucket portion 34 of the bucket element 31.

In some embodiments, at least a portion of the bucket element 31 is receivable through the candy outlet 36 when the lever element 21 is displaced toward the lower housing portion 20 for pivoting the bucket element 31 and dispensing candies 90 through the candy outlet 36. In this regard, the bucket element 31 may further comprise a bottom bucket portion 55. When the bucket element 31 is pivoted at least about the first pivot axis of rotation 101, the bottom bucket portion 55 becomes obliquely angled relative to the candy outlet 36 and the outlet plane 106 for guiding candies 90 of the candy column bottom 92 from the bucket element 31 when in a fully pivoted candy-dispensing state or configuration.

Figure 10A:
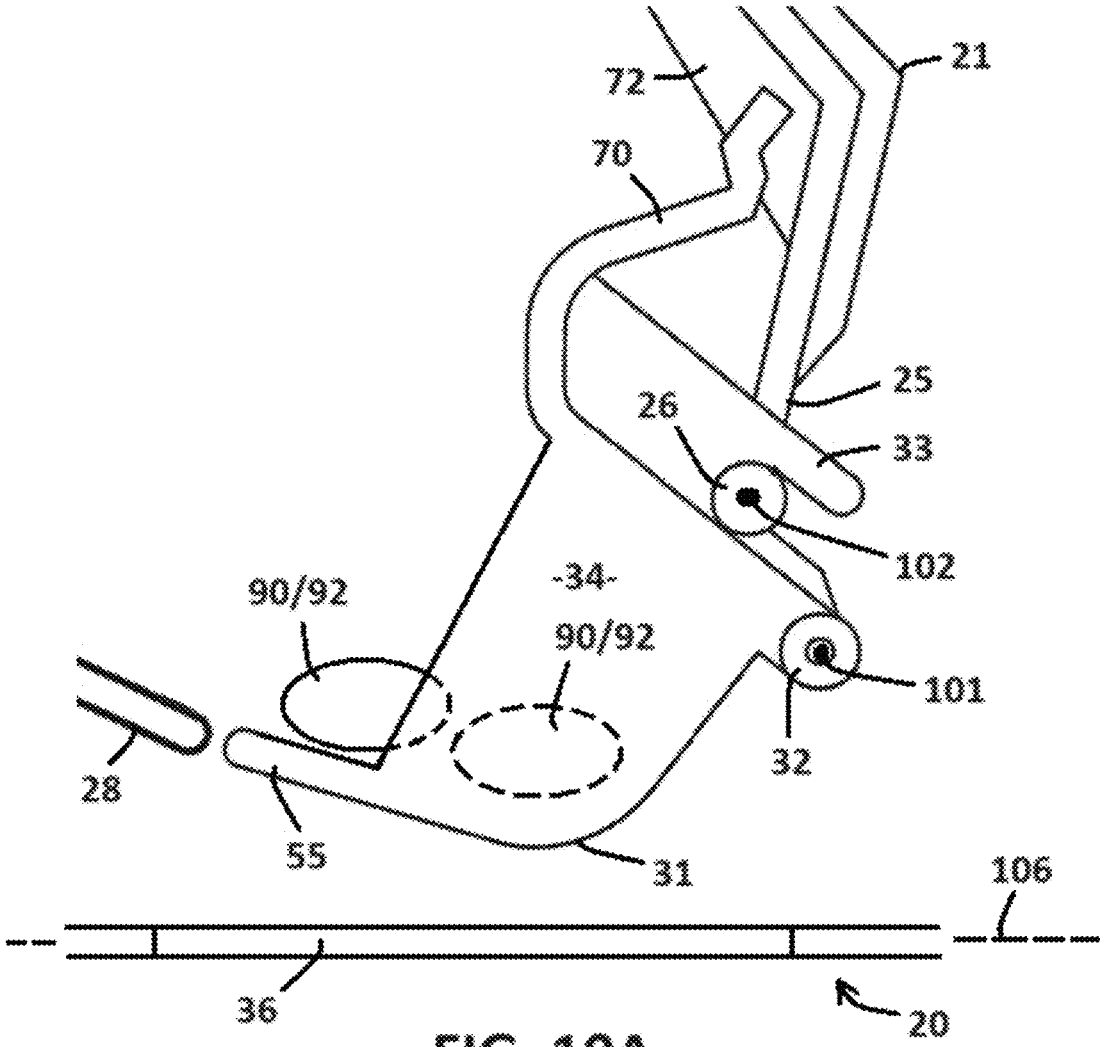
FIG. 10A is an enlarged sectional view of the bucket element in communication with a fragmentary lever element and juxtaposed adjacent lower housing portions of the candy dispenser before dispensing candies from the lower housing portions.
Figure 10B:
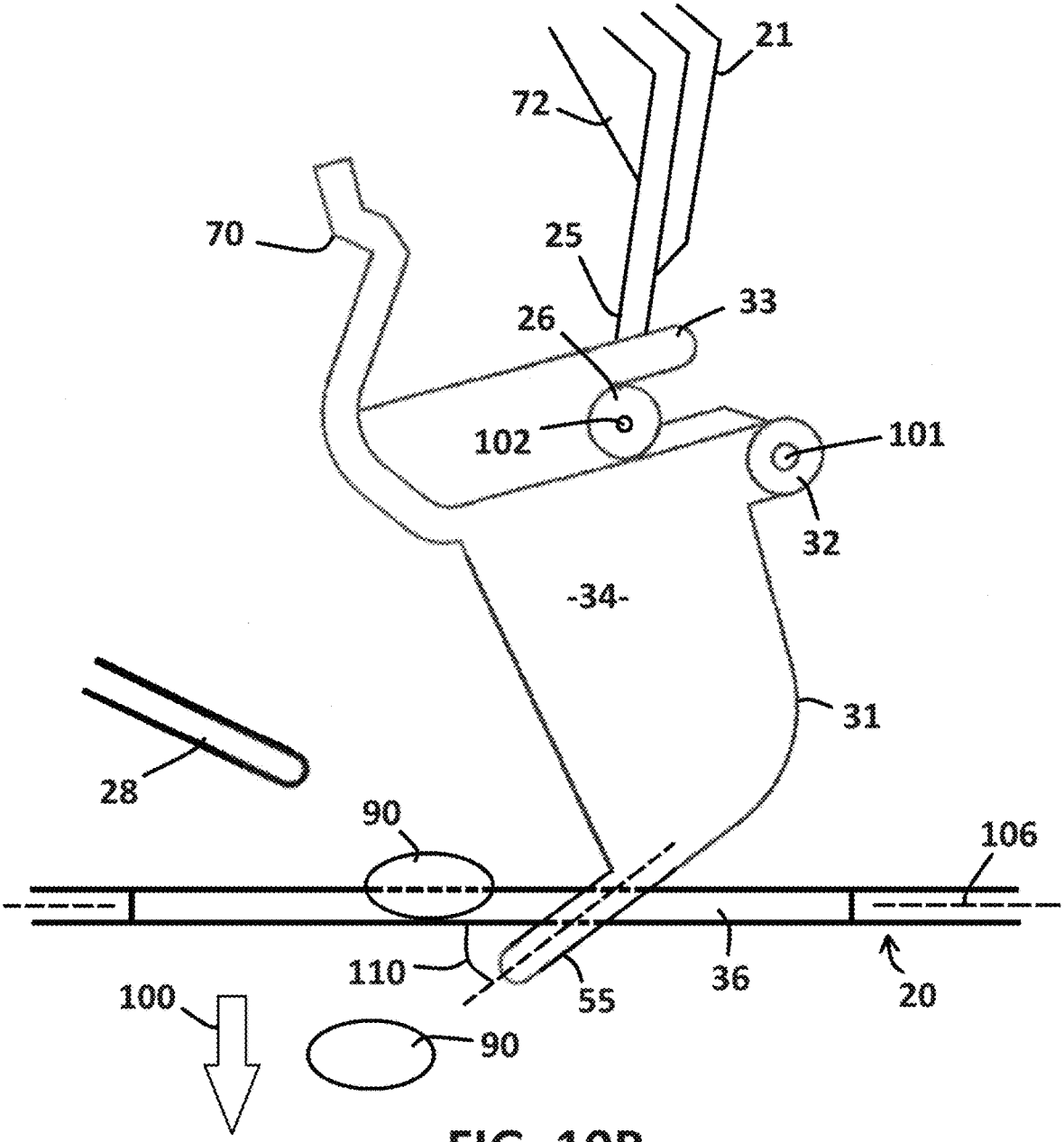
FIG. 10B is an enlarged sectional view of the bucket element in communication with a fragmentary lever element and juxtaposed adjacent lower housing portions of the candy dispenser as candies are dispensed from the lower housing portions.
Figure 11:
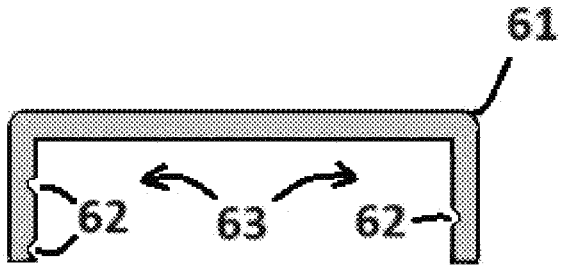
FIG. 11 is an enlarged cross-sectional view of a first alternative cap element according to the presently disclosed subject matter.

In this regard, when the external button element 41 is fully depressed as at arrow 103 for directing and displacing lower portions of the lever element 21 toward the lower housing portion 20, the bottom bucket portion pivots from the position depicted in FIG. 10A to the position depicted in FIG. 10B. In other words, the obliquely angled bottom bucket portion 55 is angled toward the anterior housing portion 45 at an oblique angle 110 opposite that of the internal housing ramp 28 for guiding dispensing candies 90 in a direction opposite candies 90 that are directed into the bucket element 31 from the internal housing ramp 28 when in the unit is in a relaxed state.

In some embodiments, to help aid the movement or migration of candies 90 within the candy column 91 toward the candy column bottom 92, the candy dispenser 10 may further comprise an auger or agitator element as at 56. In some embodiments, the candy column agitator element 56 is coupled to the lever element 21 within the lower posterior housing compartment 47 and extends through an internal housing wall aperture 57 formed in the internal housing wall 22. The agitator element 56 is displaceable when the lever element 21 is displaced intermediate the upper housing portion 19 and the lower housing portion 20 by depressing action at the external button element 41 and return of the external button element 41 via resilient return action of the compression spring 42. The compression spring is referenced at 42' in FIG. 9B to depict a fully compressed compression spring and is otherwise referenced at 42 when in a relaxed configuration.

In some embodiments, the displacement of the candy column agitator element 56 is operable to move through the candy column 91 thereby agitating the candies 90 within the candy column 91 for aiding directional advancement thereof toward the candy column bottom 92. In some embodiments, the agitator element 56 also extends through an internal housing ramp aperture 58 formed in the internal housing ramp 28. The internal housing ramp aperture 58 helps position a lower end 59 of the agitator element 56 while allowing displacements thereof generally along its axis. Together the internal housing wall aperture 57 and the internal housing ramp aperture 58 together guide the agitator element 56 through the candy column 91 for agitating the same when the lever element 21 is displaced intermediate the upper housing portion 19 and the lower housing portion 20.

In some embodiments, the agitator element 56 may comprise an array of ridged or bulbous formations 60 that may operate to further agitate the candies 90 of the candy column 91 during displacements of the agitator element 56. In other words, in some embodiments, the agitator element 56 may further comprise a ridged exterior surface, which ridged exterior surface is configured to enhance agitation of candies 90 within the candy column 91 when the lever element 21 and agitator element 56 undergo displacements by depressing action 103 at the external button element 41 and its return to the relaxed state by way of the compression spring 42. In other words, the agitator element 56 extends through the candy column 91 and moves to and fro while candies 90 generally migrate downwardly toward the lower housing portion 20 for dispensing action via the candy outlet 36.

In some embodiments, the bucket element 31 may further comprise a bucket limiter element as at 70. When the external button element 41 is released and returns to the relaxed state under resilient return action of the compression spring 42, the bucket element 31 also pivots about the first pivot axis of rotation 101 to return to its relaxed state for candy collection within the candy-holding bucket portion 34 at the candy column bottom 92. When returning to the relaxed state or configuration, the bucket limiter element 70 engages a portion of the lower lever end 25. In some embodiments, the bucket limiter element 70 extends upwardly from the laterally opposed coupler elements 33 and comprises a slotted central portion 71 for receiving a central lower lever portion 72 of the lever element 21 extending upwardly from the lower lever end 25. Accordingly, in some embodiments, the bucket limiter element 70 flanks at least a portion of the lever element 21 during return action of the bucket element 31 to its relaxed state.

As introduced hereinabove, in some embodiments, the candy dispenser 10 may further comprise a removable cap element 61. In some embodiments, the removable cap element 61 may comprise threaded internal surfacing 62 at an internal cap portion 63. In some embodiments, the upper housing portion 19 may comprise threaded external surfacing 64 at an external upper housing portion 65 in superior adjacency to the cap seat as provided by the circumferential ridge formation 51. In some embodiments, the threaded internal surfacing 62 of the internal cap portion 63 and the threaded external surfacing 64 of the external upper housing portion 65 together enable securement of the removable cap element 61 to the upper housing portion 19 for capping or covering the candy-receiving opening 35.

Figure 12:
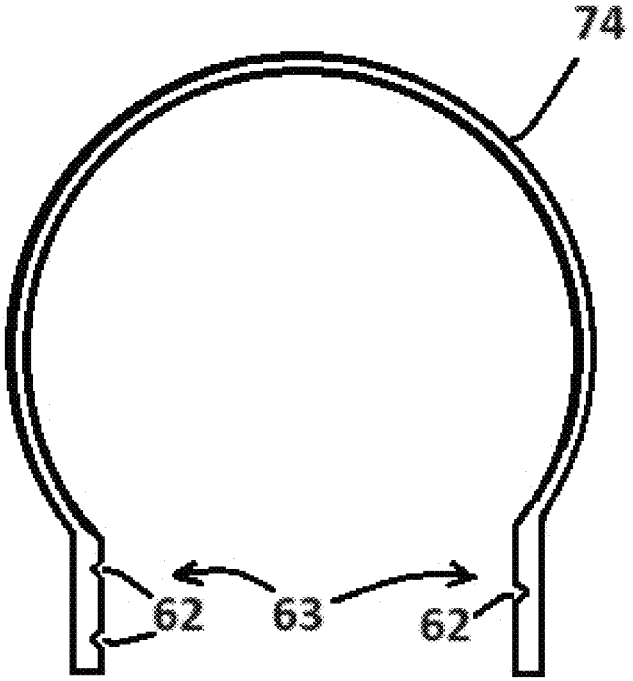
FIG. 12 is an enlarged cross-sectional view of a second alternative cap element according to the presently disclosed subject matter.

In some embodiments, the removable cap element 61 may be snap fit upon the upper housing portion 19 without matable threaded surfacing. While the removable cap element 61 has been illustrated to include threaded fastening means, this is intended to be illustrative only, and should not be construed as limiting. In some embodiments, the removable cap element 61 may further comprise ornamental external surfacing for at least enhancing the visual appeal of or customizing the candy dispenser 10. In some embodiments, for example, certain external surfacing of the cap element 61 may be outfitted with brand or logo information as at generic logo 68. Further, the shape of the cap element 61 need not be cylindrical. FIGS. 1-3 and 4-8, for example, generally depict a cylindrical cap element 61 whereas FIG. 12 attempts to depicts a spherical cap element 74 for comparison purposes.

The candy dispenser 10 thus enables a user to load candies 90, temporarily store candies 90, and selectively dispense candies 90 from the unit. In some embodiments, the candy dispenser 10 is portable and handheld and the candies 90 and 90A through 90E that may be dispensed therefrom may be of differing sizes and shapes. The candy dispenser 10 may, in some embodiments be portable and handheld and comprise a housing 11 configured to fit within a user's hand 200. The housing 11 comprises an anterior or front side as at 45, a posterior or back side as at 44, laterally opposed sides as at 18, an upper housing end or portion as at 19, and a lower housing end or portion as at 20. In some embodiments, the anterior side 45 is configured to ergonomically engage a user's fingers 202-205 and the posterior side 44 is configured to engage a user's thumb prominence 206.

The upper housing end 19 comprises a candy inlet 35 outfitted with a removable cap element 61 in some embodiments. In some embodiments, internal thread formations 62 of the cap element 61 are configured to screw onto threaded outer surfacing 64 at the upper housing end 19 in radial outer adjacency relative to the candy inlet 35. The lower housing end 20 of the housing 11 comprises a candy outlet 36. Relatively small or bite-size candies 90 as variously sized and shaped are insertable into the housing 11 via the candy inlet 35 and selectively dispensed via the candy outlet 36 at the lower housing end 20.

The user may selectively dispense candies 90 by thumb-depressing a spring-biased button element 41 positioned so as to engage the user's opposable thumb 201 in some embodiments. The spring-biased button element 41 extends upwardly from the housing 11 at the posterior side 44 by way of a button-positioning portion of the housing 11 formed at the posterior side 44 in some embodiments. The spring-biased button element 41 comprises a button shaft or post 43 and a spring mechanism 42 extending within the button-positioning portion through a shaft or post-receiving aperture 69 formed in the housing 11.

In some embodiments, the spring-biased button element 41 and an associated lever mechanism 21 in line therewith is in structural communication with a candy-mixing or candy-agitating agitator mechanism 56 and a bucket element 31. By depressing the spring-biased button element 41 via a user's thumb 201 or other digit, the candy-mixing agitator mechanism 56 agitates candies 90 within a candy column 91. In some embodiments, bulbous formations 60 extend through a column of candies 90 within a candy-housing compartment 16 of the candy dispenser 10 for agitating the same for aiding migration of the candies 90 toward the bucket element 31. The radially extending bulbous formations 60 formed on the agitator shaft extend through a candy-holding space in anterior adjacency to the button-positioning portion within the housing 11 in some embodiments.

In other words, candies 90 received in the candy-holding space or candy-housing compartment as at 16 are agitated by the radially extending arms or bulbous formations 60 during action of button depression as at 103 thereby directing candies 90 into the candy-receiving bucket element 31. The candy-receiving bucket element 31 pivots about a bucket pivot axis of rotation 101 from a relaxed, candy-receiving position as generally depicted in FIG. 10A to an actuated candy-letting position as generally depicted in FIG. 10B at which candy-letting position candies 90 are outlet or dispensed via the candy outlet 36 for sharing or consumption.

In some embodiments, the resilient return action at the spring-biased button element 41 returns the candy-receiving bucket element 31 to the relaxed, candy-receiving position to receive a successive bucket load of candies 90 for subsequent candy dispensing. The spring-biased button element 41 may be repeatedly depressed and returned in this manner to dispense all candies 90 from the candy-holding space or candy-housing compartment 16 at which time the candy dispenser 10 may be re-filled with candies 90 to repeat the cycle of candy dispensing. In some embodiments, a loop feature or formation 66 is optionally formed at the upper housing end 19 at the anterior side 45 to allow a user to attach an optional key ring or carabiner as at 67.

What is claimed is:

1. A candy dispenser for enabling a user to store and selectively dispense candies therefrom, the candy dispenser comprising:

a housing comprising a candy-housing compartment, laterally opposed housing portions, an upper housing portion, and a lower housing portion;

a lever element, the lever element being displaceable relative to the upper housing portion and the lower housing portion and comprising a lower lever end, the lower lever end comprising laterally opposed lever pin elements;

a bucket element, the bucket element being positioned adjacent the lower housing portion and coupled to the lever element, the bucket element being pivotal about a first pivot axis of rotation when the lever element is displaced;

the bucket element comprising laterally opposed bucket pin elements and laterally opposed coupler elements, the laterally opposed bucket pin elements extending laterally from the bucket element along the first pivot axis of rotation and being rotatably held at the laterally opposed housing portions;

the laterally opposed lever pin elements being pivotally held by the laterally opposed coupler elements for defining at least a second pivot axis of rotation extending through the laterally opposed lever pin elements;

the candy-housing compartment being configured to receive and store at least a candy therewithin deliverable thereto via the upper housing portion;

the lever element being displaceable toward the lower housing portion for pivoting the bucket element about the first pivot axis of rotation for selectively dispensing the candy from the bucket element via the lower housing portion.

2. The candy dispenser according to claim 1, wherein the housing comprises at least a first housing compartment and a second housing compartment, the first housing compartment defining the candy-housing compartment and being separated from the second housing compartment by an internal housing wall.

3. The candy dispenser according to claim 2, wherein the first housing compartment comprises an internal housing ramp, the internal housing ramp being obliquely angled relative to a longitudinal compartment axis of the first housing compartment for guiding the candy into the bucket element.

4. The candy dispenser according to claim 1, wherein the lever element comprises an external button element, the external button element being depressable by a user for displacing the lever element toward the lower housing portion.

5. The candy dispenser according to claim 4, comprising a compression spring in communication with the external button element, the compression spring for returning the external button element to a relaxed button position after the user releases the external button element.

6. The candy dispenser according to claim 5, wherein the second housing compartment comprises an upper housing compartment and a lower housing compartment separated by an internal spring support wall, the internal spring support wall for supporting the compression spring during depression of the external button element.

7. The candy dispenser according to claim 6, wherein the external button element comprises an upper button surface, the upper button surface being obliquely angled relative to the internal spring support wall.

8. The candy dispenser according to claim 7, wherein the housing comprises a button lock element, the button lock element being configured to selectively prevent downward displacement of the lever element.

9. The candy dispenser according to claim 1, comprising a removable cap element and wherein the upper housing portion comprises a candy-receiving opening configured to receive the candy, the removable cap element being configured to removably cap the candy-receiving opening.

10. The candy dispenser according to claim 9, wherein the cap element comprises external surfacing configured to at least enhance the visual appeal of or customize the candy dispenser.

11. The candy dispenser according to claim 1, wherein the lower housing portion comprises a candy outlet, the candy outlet being configured to dispense the candy therethrough when the lever element is displaced toward the lower housing portion.

12. The candy dispenser according to claim 11, wherein at least a portion of the bucket element is receivable through the candy outlet when the lever element is displaced toward the lower housing portion.

13. The candy dispenser according to claim 12, wherein the bucket element comprises a bottom bucket portion, the bottom bucket portion being obliquely angled relative to the candy outlet for guiding the candy from the bucket element when in a fully pivoted state.

14. The candy dispenser according to claim 4, wherein the housing is configured to be ergonomically held by a user hand comprising an anterior housing exterior surface and a posterior housing exterior surface, the anterior housing surface comprising an array of ridge and trough formations for ergonomically receiving an array of user fingers as cupped thereat, the posterior housing surface for abutting a user thumb prominence such that a user opposable thumb may depress the external button element while the array of user fingers, as cupped at the anterior housing surface, direct the housing toward the thumb prominence thereby enabling the candy dispenser to be firmly secured within the user hand.

15. The candy dispenser according to claim 1, comprising an agitator element, the agitator element being coupled to the lever element and being displaceable when the lever element is displaced for agitating the candy.

16. The candy dispenser according to claim 15, wherein the agitator element extends through at least one internal housing aperture, said internal housing aperture being configured to guide the agitator element when the lever element is displaced.

17. The candy dispenser according to claim 16, wherein the agitator element comprises a ridged exterior surface configured for enhancing agitation of the candy when the lever element is displaced.

18. The candy dispenser according to claim 1, wherein the at least a portion of the housing is formed from a translucent material for enabling a user to see objects within the housing.

19. A handheld candy dispenser configured to manually dispense candies therefrom, the handheld candy dispenser comprising:

a housing comprising a candy-housing compartment, laterally opposed housing portions, an upper housing portion, and a lower housing portion;

a lever element, the lever element being manually displaceable relative to the upper housing portion and the lower housing portion and comprising a lower lever end, the lower lever end comprising laterally opposed lever pin elements;

a bucket element, the bucket element being positioned adjacent the lower housing portion and coupled to the lever element, the bucket element being pivotal about a first pivot axis of rotation when the lever element is displaced;

the bucket element comprising laterally opposed bucket pin elements and laterally opposed coupler elements, the laterally opposed bucket pin elements extending laterally from the bucket element along the first pivot axis of rotation and being rotatably held at the laterally opposed housing portions;

the laterally opposed lever pin elements being pivotally held by the laterally opposed coupler elements for defining at least a second pivot axis of rotation extending through the laterally opposed lever pin elements;

the candy-housing compartment being configured to receive and store candies therewithin deliverable thereto via the upper housing portion;

the lever element being manually displaceable toward the lower housing portion for pivoting the bucket element about the first pivot axis of rotation for dispensing the candies from the bucket element via the lower housing portion.

20. The handheld candy dispenser according to claim 19, wherein the at least a portion of the housing is formed from a translucent material for enabling a user to see objects within the housing.

* * * * *